US008894370B2

(12) United States Patent
Wassynger et al.

(10) Patent No.: US 8,894,370 B2
(45) Date of Patent: Nov. 25, 2014

(54) TURBINE BLADE RETENTION SYSTEM AND METHOD

(75) Inventors: Stephen P. Wassynger, Simpsonville, SC (US); Nick Martin, Simpsonville, SC (US); Steven E. Tomberg, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1402 days.

(21) Appl. No.: 12/078,757

(22) Filed: Apr. 4, 2008

(65) Prior Publication Data

US 2009/0252610 A1 Oct. 8, 2009

(51) Int. Cl.
*F01D 9/04* (2006.01)

(52) U.S. Cl.
CPC ..... *F01D 9/042* (2013.01)
USPC ..... 416/220 R; 416/221

(58) Field of Classification Search
CPC ..... F01D 5/22; F01D 5/26; F01D 25/04; F01D 2240/14; F01D 2260/30
USPC ..... 416/220 R, 221
See application file for complete search history.

(56) References Cited

U.S. PATENT DOCUMENTS

| | | | | | |
|---|---|---|---|---|---|
| 2,713,991 | A | * | 7/1955 | Secord et al. | 416/221 |
| 2,833,463 | A | * | 5/1958 | Walton | 415/209.1 |
| 3,165,294 | A | | 1/1965 | Anderson | |
| 3,326,523 | A | * | 6/1967 | Bobo | 415/209.3 |
| 3,338,508 | A | * | 8/1967 | Castle et al. | 415/209.1 |
| 3,339,833 | A | * | 9/1967 | Arthur et al. | 416/219 R |
| 3,377,050 | A | * | 4/1968 | Guy | 416/191 |
| 3,393,436 | A | * | 7/1968 | Blackhurst et al. | 29/889.22 |
| 3,521,974 | A | | 7/1970 | Zerlauth | |
| 3,601,500 | A | * | 8/1971 | Palfreyman et al. | 416/190 |
| 3,603,702 | A | | 9/1971 | Jensen | |
| 3,997,280 | A | * | 12/1976 | Germain | 415/189 |
| 4,265,595 | A | | 5/1981 | Bucy, Jr. et al. | |
| 4,453,891 | A | | 6/1984 | Forestier | |
| 4,478,554 | A | | 10/1984 | Surdi | |
| 4,502,841 | A | * | 3/1985 | Kebedjis | 416/220 R |
| 4,889,470 | A | * | 12/1989 | Scalzo | 415/209.2 |
| 4,895,490 | A | * | 1/1990 | Kasperski | 416/221 |

(Continued)

FOREIGN PATENT DOCUMENTS

| | | | |
|---|---|---|---|
| CN | 101008328 | A | 8/2007 |
| EP | 0110744 | B1 | 10/1986 |

(Continued)

OTHER PUBLICATIONS

Wassynger et al., entitled, "Turbine Blade Retention System and Method," U.S. Appl. No. 12/078,757, filed Apr. 4, 2008, pending.

(Continued)

*Primary Examiner* — Edward Look
*Assistant Examiner* — Sean J Younger
(74) *Attorney, Agent, or Firm* — Nixon & Vanderhye P.C.

(57) ABSTRACT

A retention system retains a turbine blade dovetail in a retention ring dovetail slot. The retention system includes a retention opening formed in the blade dovetail. A through hole is formed in the retention ring, wherein the through hole is positioned such that it is aligned with the retention opening when the dovetail is assembled in the dovetail slot. A connector is disposed in the through hole and engages the retention opening. In this manner, undesirable relative movement of parts can be reduced or eliminated, thereby preventing excessive wear.

12 Claims, 4 Drawing Sheets

(56) References Cited

U.S. PATENT DOCUMENTS

| | | | | |
|---|---|---|---|---|
| 5,022,818 | A * | 6/1991 | Scalzo | 415/209.3 |
| 5,100,292 | A | 3/1992 | Matula et al. | |
| 5,141,395 | A * | 8/1992 | Carroll et al. | 415/196 |
| 5,282,720 | A | 2/1994 | Szpunar | |
| 5,622,475 | A | 4/1997 | Hayner et al. | |
| 5,624,233 | A * | 4/1997 | King et al. | 416/219 R |
| 5,860,787 | A * | 1/1999 | Richards | 416/220 R |
| 6,010,304 | A | 1/2000 | Moniz et al. | |
| 6,398,500 | B2 | 6/2002 | Pedersen et al. | |
| 6,884,028 | B2 | 4/2005 | Brauer et al. | |
| 6,981,847 | B2 | 1/2006 | Arinci et al. | |
| 6,984,108 | B2 * | 1/2006 | Anderson et al. | 415/209.3 |
| 2002/0004010 | A1 | 1/2002 | Pedersen et al. | |
| 2004/0062643 | A1 | 4/2004 | Brauer et al. | |
| 2007/0177973 | A1 * | 8/2007 | Seki et al. | 415/191 |

FOREIGN PATENT DOCUMENTS

| | | | |
|---|---|---|---|
| GB | 2313162 | A | 11/1997 |
| GB | 2364554 | A | 1/2002 |
| JP | 11247616 | A | 9/1999 |
| JP | 2007138944 | A | 6/2007 |

OTHER PUBLICATIONS

Search Report from CN Application No. 200910133443.7 dated Dec. 29, 2012.

Office Action from JP Application No. 2009-077943 dated May 21, 2013.

* cited by examiner

TURBINE BLADE RETENTION SYSTEM AND METHOD

BACKGROUND OF THE INVENTION

The invention relates to a retention system used to prevent axial and/or radial movement of a shaped object in a correspondingly shaped slot and, more particularly, to a retention system and method for retaining a turbine blade dovetail in a retention ring dovetail slot.

In a conventional turbine compressor component, stator blades are held in a retaining ring by means of a dovetail connection (i.e., a dovetail on the blade is received in a complimentary slot in the retaining ring), and the retaining ring, in turn, is secured within a circumferential slot in the compressor casing.

The fit between the blade and the dovetail slot in the ring is loose to allow for assembly and tolerances. Therefore, if the blades are not properly retained, the loose fit may allow the hardware to move in the slot, leading to excessive wear. The excessive wear would eventually fail the part, requiring the unit to be shut down until a repair can be made.

Additionally, radial movement of the blade in the dovetail slot allows for a variation of the tip radius during the machining process. Reduced variation in radial clearance could potentially increase performance and avoid excessive tip rubs.

Typically, each stator blade is retained in the ring to limit motion along the ring dovetail slot by one or more stakes. This is a process where material at the edge of the ring slot is plastically deformed and displaced into a void created by a local chamfer of the stator dovetail. This is a manual and highly variable process which can in some cases provide inadequate retention of the stator blade in the ring slot. Vibratory forces acting on the stator can produce wear on the stake leading to eventual failure of the retention feature. Once the stake is worn, the blade can then slide freely in the ring slot. At very high amplitudes, this motion can lead to wearing of the ring dovetail and eventual failure of the ring. This could then lead to blade liberation and subsequent collateral damage to the gas turbine. This problem has been addressed in recent designs of the assignee via a set screw solution, disclosed in commonly-owned, pending application Ser. No. 11/282,603, filed Nov. 21, 2005. There have also been many documented instances of stators being installed incorrectly either by inserting the airfoil in the ring backwards or inserting the stator or ring in the wrong axial position (stage). Some of these mis-assemblies have been identified as causes of subsequent failure of machine equipment.

There remains a need, however, for a reliable, mistake-proof retention technique for securing airfoil stator blading in turbo-machinery.

BRIEF DESCRIPTION OF THE INVENTION

In one exemplary embodiment, the invention relates to a retention system for use in assembling a turbine blade dovetail a mating dovetail slot in a retaining ring, the retention system comprising: a first retention slot formed in the blade dovetail; a second retention slot formed in a retaining ring, the second slot in open communication with the first retention slot, wherein the first retention slot is positioned such that it is aligned with the second retention slot when the dovetail is assembled in the dovetail slot; and a locking member disposed in the first and second retention slots.

In another aspect, the invention relates to a method of retaining a turbine blade dovetail in a retention ring dovetail slot comprising: forming a retention slot in the blade dovetail; forming a locking slot in the retention ring such that the locking slot opens into the retention slot; and inserting a locking member in the retention slot and the locking slot.

The invention will now be described in detail in connection with the drawings identified below.

The following detailed description of an exemplary, non-limiting embodiment of the present invention is applied to gas turbine compressor stator blades that are retained in the compressor casing via a retaining ring (typically comprised of plural arcuate segments). This embodiment, however, is exemplary only, and the invention is intended to embrace any other application where it is desired to retain a part within a slot.

DETAILED DESCRIPTION OF THE INVENTION

Figure 1:
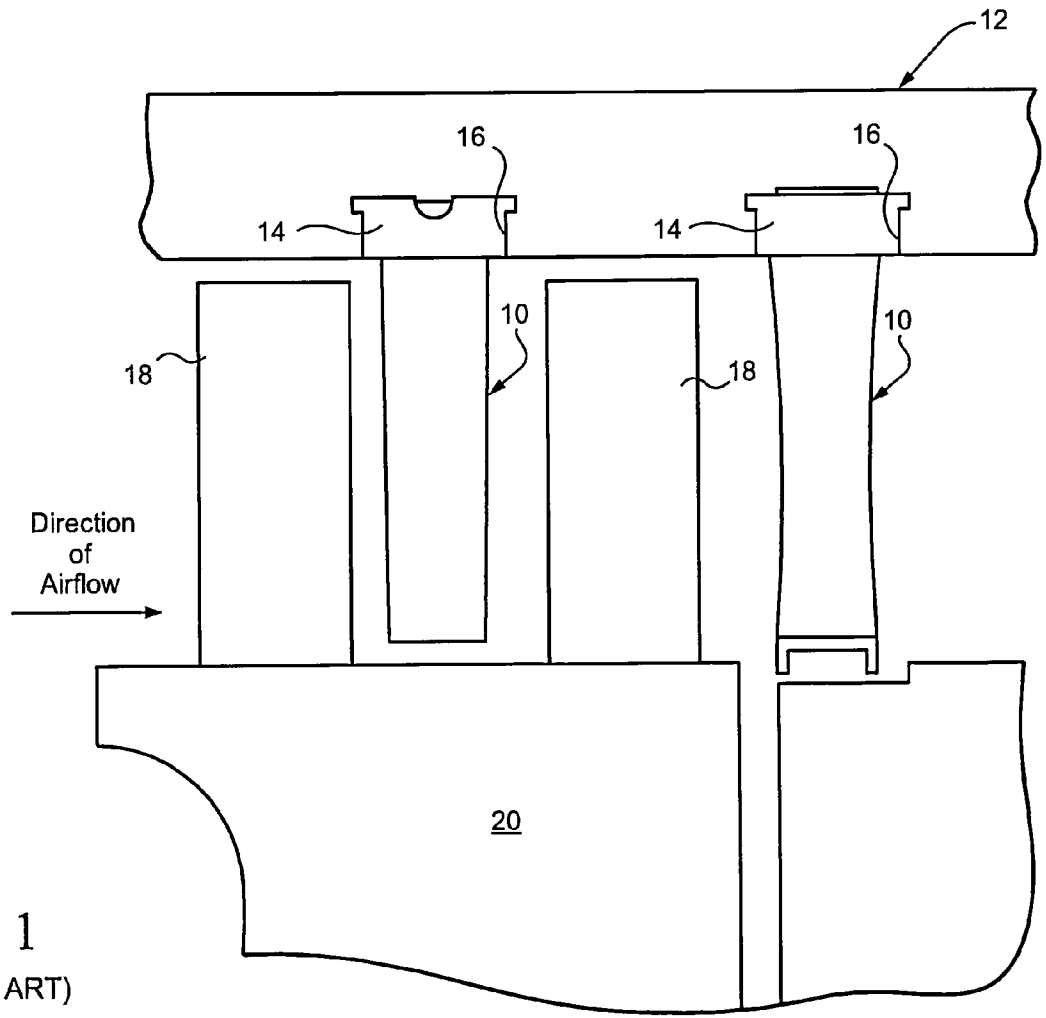
Fig. 1 (PRIOR ART)
FIG. 1 is a partial, simplified cross section of a conventional compressor assembly.

FIG. 1 is a simplified cross section showing turbine stator blades 10 in a conventional compressor, represented by a static casing 12. The blades are typically secured via a dovetail section (not shown) engaging a correspondingly shaped dovetail slot (not shown) in a stator retaining ring 14. The retaining rings, in turn, are slidably received and secured within circumferential slots 16 in the casing 12. The stator blades 10 alternate in an axial direction with blades 18 extending radially outwardly from the rotor 20. Radially inner ends of the stator blades may be shrouded or unshrouded, but that aspect is not important for purposes of this invention. It will be appreciated that ring 14 may be composed of two or more arcuate segments.

Figure 2:
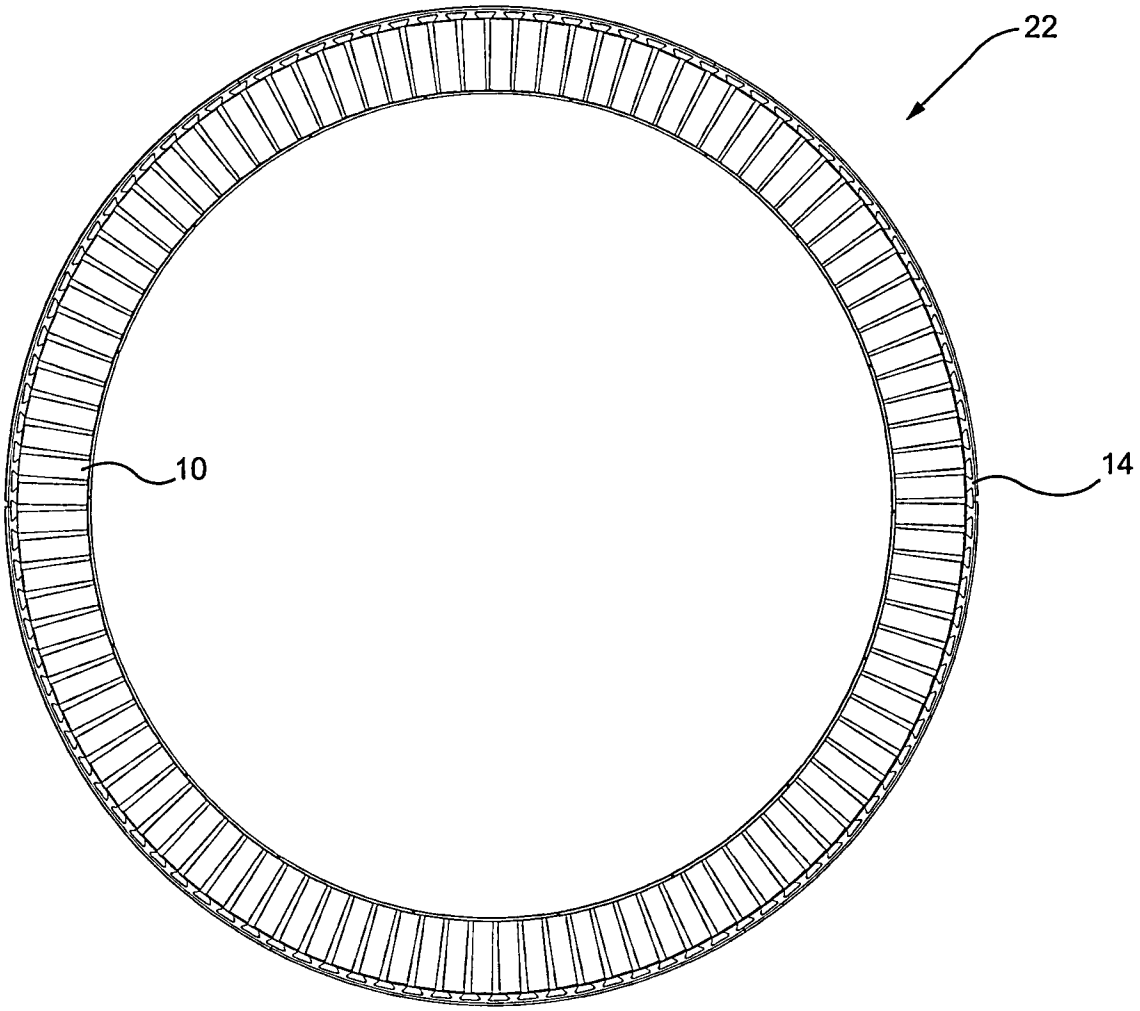
Fig. 2 (PRIOR ART)
FIG. 2 is a forward view looking aft of a conventional stator ring assembly.

FIG. 2 illustrates one stator ring assembly 22 wherein a plurality of (gas turbine) stator blades 10 are secured within the stator retaining ring 14.

Figures 3, 4:
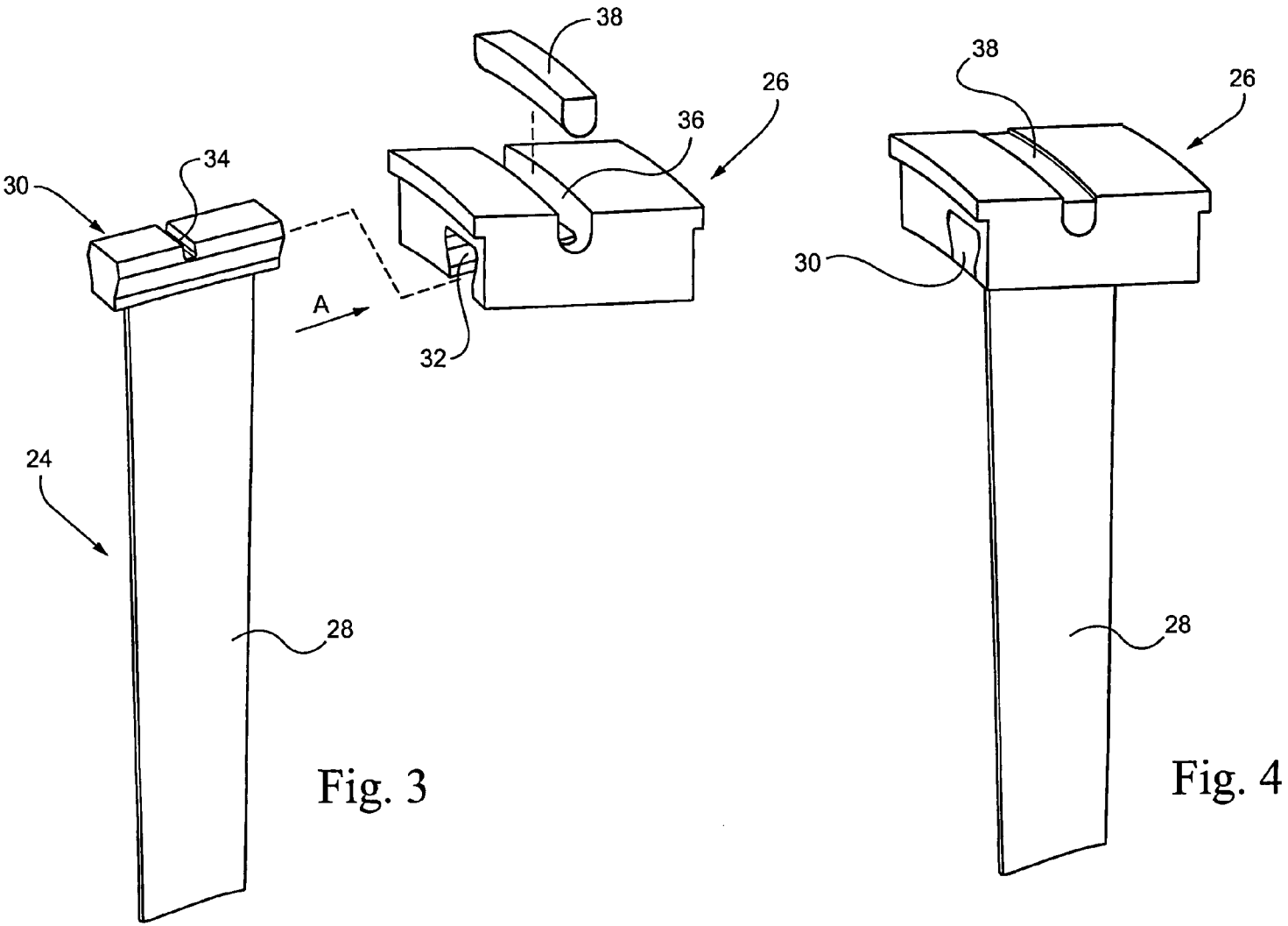
FIG. 3 is an exploded view showing a blade retention system in accordance with an exemplary, non-limiting embodiment disclosed herein.
FIG. 4 shows an assembled view of the retention system shown in FIG. 3.

FIG. 3 is an exploded perspective view of a blade retention system for securing a gas turbine compressor stator blade 24 within a retaining ring 26 in accordance with an exemplary, non-limiting embodiment of the invention. Each turbine blade 24 includes an airfoil 28 and a blade dovetail 30 at one end thereof which is assembled into a correspondingly-shaped dovetail slot 32 in a retaining ring 26 that is similar to the ring 14 (FIGS. 1, 2) except as noted below.

In the exemplary embodiment, a retention slot 34 is formed in the blade dovetail 30, with the slot oriented substantially perpendicular to an axial insertion direction A of the dovetail 30 into the dovetail slot 32. In other words, retention slot 34 extends in substantially the same circumferential direction as the retaining ring 26, that is substantially perpendicular to the length dimension of the blade dovetail 30. A lock wire slot 36 is formed in the retaining ring 26, also in the circumferential direction, and in open communication with the dovetail slot 32 that receives the stator blade dovetail 30, and thus also substantially perpendicular to the blade dovetail 30. Thus, upon assembly, the retention slot 32 and the lock wire slot 36 are aligned in a radial direction such that a lock wire 38 may be inserted into both slots 36 and 32 to thereby retain the stator blade dovetail 30 in the ring 26 (see FIG. 4). Note that the lock wire 38 provides both radial and axial positioning and retention. In this regard, the wire 38 pressed into the slot 36 takes up any radial slack between the dovetail 30 and slot 32 while at the same time, preventing any movement of the dovetail 30 axially along the slot 32. Moreover, by placing the slot 34 asymmetrically along the length of the dovetail 30, mistake-proof assembly of stator blade insertion into the ring slot 32 is assured.

Figure 5B:
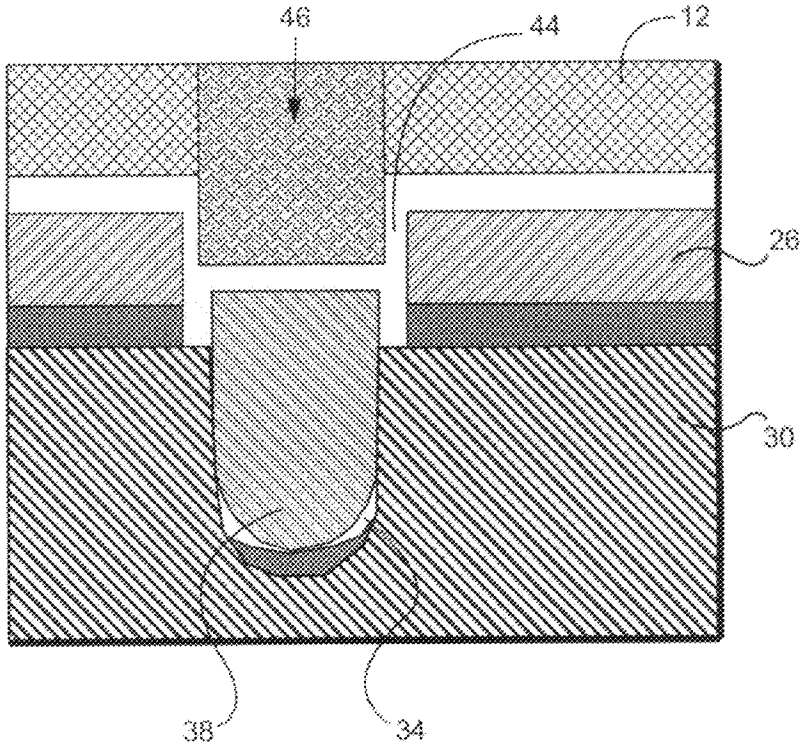
FIG. 5B is a view similar to FIG. 5A but showing an arrangement without a radial retention feature.
Figure 5A:
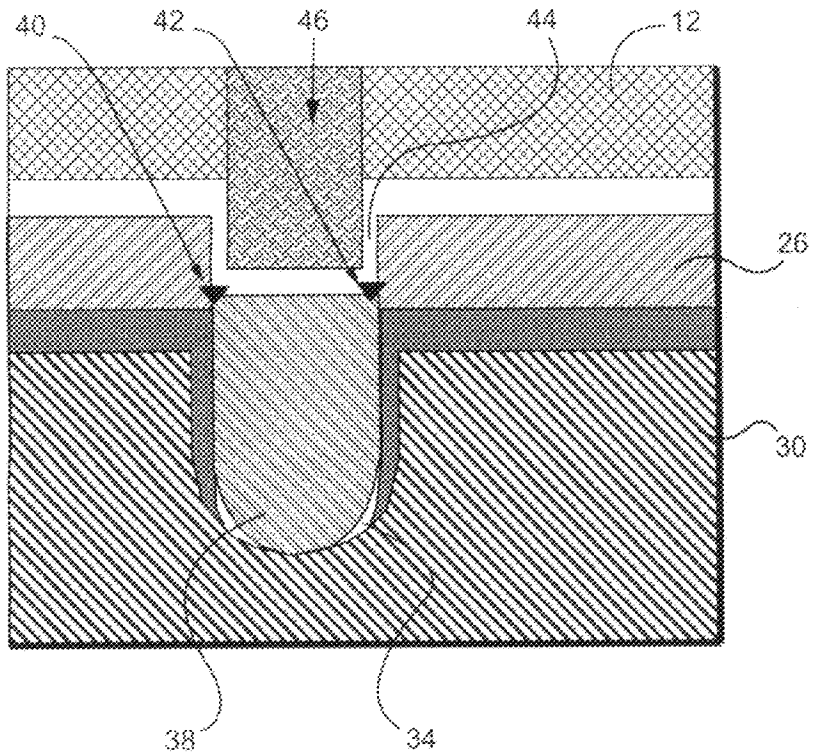
FIG. 5A shows a schematic cross sectional view of the system shown in FIG. 4.

Turning now to FIGS. 5A and B, the locking wire 38, when fully inserted within the lock wire slot 36, may be staked at opposite sides 40, 42 thereof to retain the lock wire in place. When fully inserted, the lock wire may provide a gap or recess 44 above the wire and within the ring 26. This arrangement leaves room for a locating pin 46 placed in the case (see 12 in FIG. 1) to provide mistake-proofing of the ring-stator assembly within the case. In this way, it is possible to assemble the stators within the ring in only one fashion, and to assemble the stator ring assembly within the case in only one fashion.

Note that in FIG. 5A, both axial and radial retention are achieved while in FIG. 5B, absent staking at 40, 42, only axial retention is provided. However, in the case of FIG. 5B, a radially oriented set screw or the like, inserted through the vane ring 44 (adjacent the lock wire), could be employed to provide radial retention. Note that in FIG. 5B, the lock wire need not be fully inserted as shown in FIG. 5A, and it may have a loose or tight fit within the lock wire slot 36.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A retention system for use in assembling a turbine stator blade dovetail in an axially-oriented, mating dovetail slot provided in a circumferentially-extending retaining ring secured within a circumferentially-extending slot in a casing, the retention system comprising:

a first retention slot formed in the blade dovetail;

a second circumferentially-extending retention slot formed in the circumferentially-extending retaining ring substantially transverse to said dovetail slot, said second circumferentially-extending retention slot in open communication with said first retention slot, wherein the first retention slot is positioned such that it is radially aligned with said second circumferentially-extending retention slot when the turbine blade dovetail is assembled in the mating dovetail slot; and a circumferentially-extending locking member having a cross-sectional shape substantially corresponding to said second circumferentially-extending retention slot disposed in said second circumferentially-extending retention slot radially between said retaining ring and said casing, and projecting radially into said first retention slot, wherein said circumferentially-extending locking member is interference fitted in said first retention slot and said second circumferentially-extending retention slot, with clearance between said circumferentially-extending locking member and an outer surface of said circumferentially-extending retaining ring.

2. A retention system according to claim 1, wherein said first retention slot and said second circumferentially-extending retention slot are oriented substantially perpendicular to an insertion direction of the turbine blade dovetail into the mating dovetail slot.

3. A retention system according to claim 1 wherein said circumferentially-extending locking member comprises an elongated flexible lock wire.

4. A retention system according to claim 1 wherein the first retention slot is offset from a center of the blade dovetail along an insertion direction of the of the turbine blade dovetail into the mating dovetail slot.

5. A retention system according to claim 1 including one or more pins projecting from said circumferentially-extending slot and received in said second circumferentially-extending retention slot.

6. A retention system for use in assembling a turbine stator blade dovetail in a dovetail slot formed in a retaining ring received within a circumferential slot formed in a casing, the retention system comprising:

a first retention slot formed in the blade dovetail oriented transverse to the dovetail slot;

a second retention slot formed in the retaining ring transverse to the dovetail slot, in radial alignment and in open communication with said first retention slot, said first retention slot positioned in alignment with said second retention slot when the dovetail is assembled in the dovetail slot; and a locking member, having a cross-sectional shape complimentary to said second retention slot and disposed in the second retention slot;

wherein said first and second retention slots are oriented substantially perpendicular to an insertion direction of the turbine stator blade dovetail into the retaining ring dovetail slot; and wherein said second retention slot extends annularly about said retaining ring;

wherein said locking member comprises a circumferentially-extending, elongated flexible lock wire tightly engaged within said second retention slot, and wherein said locking member is interference fitted in said first and second retention slots, with clearance between said locking member and an outer surface of said retaining ring.

7. A retention system according to claim 6 wherein the first retention slot is offset from a center of the blade dovetail along the insertion direction.

8. A retention system according to claim 6 including one or more pins projecting from said circumferential slot and adapted to be received in said second retention slot.

9. A method of retaining a turbine stator blade dovetail in a dovetail slot in a retaining ring secured to a casing comprising:

forming a retention slot in the blade dovetail substantially transverse to the dovetail slot;

forming a circumferentially-extending locking slot in the retaining ring such that the locking slot opens into the retention slot; and inserting a circumferentially-extending locking member complimentary in shape to said circumferentially-extending locking slot into said circumferentially-extending locking slot so as to project into said circumferentially-extending locking slot, wherein said circumferentially-extending locking member is interference fitted in said retention slot and said circumferentially-extending locking slot with clearance between said circumferentially-extending locking member and an outer surface of said retaining ring.

10. The method of claim 9 wherein said retention slot and said circumferentially-extending locking slot are oriented substantially perpendicular to an insertion direction of the turbine blade dovetail into the retaining ring dovetail slot.

11. The method of claim 9 wherein said circumferentially-extending locking member comprises a flexible lock wire.

12. The method of claim 9 wherein the first retention slot is offset from a center of the blade dovetail along an insertion direction of the of the turbine blade dovetail into the mating dovetail slot.

* * * * *